US005503135A

United States Patent [19]

Bunk

[11] Patent Number: 5,503,135

[45] Date of Patent: Apr. 2, 1996

[54] ARCHERY APPARATUS FOR PROPELLING AN ARROW

[76] Inventor: Paul H. Bunk, 1738 Welling, Troy, Mich. 48098

[21] Appl. No.: 258,795

[22] Filed: Jun. 13, 1994

[51] Int. Cl.[6] ..... F41B 5/00; F41B 5/10

[52] U.S. Cl. ..... 124/16; 124/25.6

[58] Field of Search ..... 124/1, 16, 21, 124/22, 23.1, 24.1, 25.6, 86, 88

[56] References Cited

U.S. PATENT DOCUMENTS

| | | | |
|---|---|---|---|
| 2,714,377 | 8/1955 | Mulkey . | |
| 3,851,638 | 12/1974 | Alexander . | |
| 3,989,026 | 11/1976 | Nishioka | 124/16 X |
| 4,461,267 | 7/1984 | Simonds et al. . | |
| 4,519,374 | 5/1985 | Miller . | |
| 4,562,824 | 1/1986 | Jennings . | |
| 4,570,606 | 2/1986 | Peck . | |
| 4,662,344 | 5/1987 | Mitchell | 124/22 |
| 4,705,015 | 11/1987 | Troncoso | 124/25.6 |
| 4,718,397 | 1/1988 | Remick . | |
| 4,817,580 | 4/1989 | Butterfield . | |
| 4,903,677 | 2/1990 | Colley et al. | 124/23.1 |
| 4,971,020 | 11/1990 | Soderstrom et al. | 124/23.1 |
| 5,054,463 | 10/1991 | Colley et al. . | |
| 5,353,777 | 10/1994 | Fincher | 124/16 |

*Primary Examiner*—Eric K. Nicholson

*Assistant Examiner*—John A. Ricci

*Attorney, Agent, or Firm*—Peter D. Keefe

[57] ABSTRACT

An archery apparatus for propelling an arrow includes a rigid main frame having a guide sheave situated at each of the opposing tips thereof. A main sheave is rotatably connected with a lower portion of the main frame. A bowstring extends between the guide sheaves, wherein each end thereof wraps around a respective periphery of mutually opposing perpheries of the main sheave and terminates connectably thereto. The actuation system of the archery apparatus includes a pair of tensioning mechanisms located on each side of the lower portion of the main frame. Each tensioning mechanism includes a coil spring, wherein a first end thereof connects to the lower portion of the main frame adjacent the guide sheave thereof and the second end of the coil spring connects to a tensioning cable. Each tensioning mechanism further includes a cam sheave connected with the lower portion of the main frame in spaced relation from both the axis of rotation of the main sheave and the second end of its respective spring. The tensioning cable of each spring wraps in fixed relation about the periphery of its respective cam sheave and then connects with the main sheave at a selected location with respect to the axis of rotation thereof. Any desired residual level of draw pull let-off of the bowstring is provided as the periphery of the cam sheaves come into alignment with the attachment location of the tensioning cables and the axis of rotation of the main sheave.

21 Claims, 3 Drawing Sheets

22
20
16a
16
10
84
28a
72
36c
60a
36'
D
30b
16b
68a
12
56
58
60b
70a
28
30a
14
36a
4
84
54a
18
38a
36
52a
82
18a
36b
82
80
38
34
50a
32
48a
50b
38b
78a
40
26
4
84
18b
46a
64
76
44a
74
24
42a
18R 22
10
16
16a
12
16b
66a
66b
68a
68b
70a
14
70b
18
35
25c
R
L
18R
18L
42a
80
62
42b
40

44b
18L
62
46b
34
52b
54b
48b
50b
70b
36
32
36
25c
38
44a
18R
46a
52a
54a
48a
18b
70a
80
50a

ARCHERY APPARATUS FOR PROPELLING AN ARROW

BACKGROUND OF THE INVENTION

1. Field of the Invention

The present invention relates to archery bows, and more particularly to archery bows having a draw pull let-off feature. Still more particularly, the present invention pertains to an archery apparatus for propelling an arrow characterized by a rigid main frame, wherein the bowstring thereof, when drawn, is tensioned by one or more resilient members in conjunction with actuation of a cam and pulley assembly.

2. Description of the Prior Art

Simple archery bows are composed of a bow member (or back) characterized by a handle having connected thereto on each side thereof a flexibly resilient limb, and a bowstring connected with opposite ends of the bow member. The archer places the nock of an arrow against the nocking point of the bowstring and then draws the bowstring, thereby causing the bow member to resiliently flex at the limbs. This flexing of the bow member supplies tension to the bowstring and stores potential energy (draw energy). When the bowstring is released, the tension of the bowstring applies a force to the arrow, whereupon the potential energy of the bow member is captured by the arrow in the form of kinetic energy. While such an archery bow has the advantage of being simply constructed, it suffers from the need of the archer to continuously supply draw pull to keep the bow member resiliently flexed. Another serious disadvantage is the essentially instantaneous application of bowstring force upon the arrow at the moment the bowstring is released, with consequent degredation of accuracy due to the imparted shock. An improved example of a simple archery bow using springs to reduce bowstring shock is described in U.S. Pat. No. 4,570,606 to Peck.

These problems have been addressed in the past with varying degrees of success, wherein it is an object to provide an archery bow having a draw pull let-off feature, while yet providing a high level of draw energy for imparting ample speed to the arrow when released.

In this regard, compound archery bows have been devised toward addressing these objects, generally utilizing a rigging of the bowstring with respect to one or more cams or pulleys which are rotatively mounted with respect to the bow member. As the bowstring is pulled back, the limbs of the bow member are caused to resiliently flex, while rotation of the cams or pulleys as the bowstring is pulled back causes the force on the bowstring to be high during pull back of the bowstring and then let-off as the maximum draw point is achieved. Examples of such compound bows are described in U.S. Pat. Nos. 4,718,397 to Remick, 4,461,267 to Simonds et al, 4,562,824 to Jennings, and 4,519,374 to Miller. Imaginative and interesting variations on this principle are found in U.S. Pat. Nos. 5,045,463 to Colley et al, 4,817,580 to Butterfield, 3,851,638 to Alexander, and 2,714,377 to Mulkey.

While compound archery bows such as those indicated hereinabove do address the objects of providing draw energy and a draw pull let-off, they suffer from one or more of the following detractions: complexity; adjustment difficulty; handling difficulty occasioned by at least one of excessive weight, bulk and/or high center of gravity; undue friction of the bowstring caused by excessively intricate rigging, inability to provide a completely adjustable draw pull let-off; and reliance on resilient flexing of the bow member to provide tension on the bowstring which reliance may limit the draw energy and may reduce accuracy due to vibration associated with bow member movement.

Accordingly, it would be desirable to provide an archery apparatus which provides a completely adjustable draw pull let-off, yet provides a high level of draw energy, and further which is not overly complex, is not cumbersome, is easily adjustable and which does not rely upon resilient flexing of the bow member to provide tensioning of the bowstring.

SUMMARY OF THE INVENTION

The present invention is an archery apparatus for propelling an arrow, but is not a bow in the truest sense, as it has no flexible limbs. The present invention provides a completely adjustable draw pull let-off and also provides a high level of draw energy, is not overly complex, is easily adjustable, is easily handled and controlled, has a very smooth, essentially vibrationless action, and does not rely upon resilient flexing of a bow member to provide tensioning of the bowstring.

The archery apparatus according to the present invention includes a rigid main frame having a guide sheave situated at each of the opposing tips thereof. A main sheave is rotatably connected with a lower portion of the main frame. A bowstring extends between the guide sheaves, wherein each end thereof wraps around a respective periphery of mutually opposing peripheries of the main sheave and terminates connectably thereto.

The actuation system of the archery apparatus according to the present invention includes a pair of tensioning mechanisms located on each side of the lower portion of the main frame. Each tensioning mechanism includes a coil spring, wherein a first end thereof connects to the lower portion of the main frame adjacent the guide sheave thereof and the second end of the coil spring connects to a tensioning cable. Each tensioning mechanism further includes a cam sheave connected with the lower portion of the main frame in spaced relation from both the axis of rotation of the main sheave and the second end of its respective spring. The tensioning cable of each spring wraps in fixed relation about the periphery of its respective cam sheave and then connects with the main sheave at a selected location with respect to the axis of rotation thereof.

In operation, as the archer draws the bowstring, the bowstring causes the main sheave to rotate. Rotation of the main sheave causes the tensioning cables to extend the springs while simultaneously causing the cam sheaves to rotate. The off-set axis of rotation of the cam sheaves results in a large stretching of the springs with relatively little movement of the bowstring, thereby causing an immediate large storage of draw energy. As the bowstring approaches its maximum draw, the cam sheaves and the main sheave will have rotated so that the periphery of the cam sheaves come into alignment with the selected location of attachment of the tensioning cables to the main sheave and further into alignment with the axis of rotation of the main sheave, thus reducing the force generated by the springs on the bowstring to any residual level desired. A stop member situated on the main sheave is preset to abut the lower portion of the main frame at the desired point of maximum draw and desired amount of draw pull let-off. The archer may then easily hold the archery apparatus in readiness for an extended time without tiring. When it is desired to release the arrow, the archer need only gently release the bowstring, whereupon the actuation system will convert the draw energy into kinetic energy of the arrow in a smooth and essentially vibrationless manner which ensures high velocity and high accuracy of the arrow.

Accordingly, it is an object of the present invention to provide an archery apparatus having very high accuracy as a result of having a rigid main frame.

It is an additional object of the present invention to provide an archery apparatus having an extremely smooth action wherein tensioning of the bowstring thereof is provided by springs without flexing of the main frame.

It is a further object of the present invention to provide an archery apparatus capable of imparting very high kinetic energy to an arrow by operation of an actuation system featuring springs and cooperating main and cam sheaves.

It is another object of the present invention to provide an archery apparatus wherein the level of draw pull let-off can be selected to any value desired.

It is yet a further object of the present invention to provide an archery apparatus which provides for a high draw energy, a fully adjustable draw pull let-off, and an inflexible main frame.

It is yet another object of the present invention to provide an archery apparatus which provides for a high draw energy, a fully adjustable draw pull let-off, and has bowstring tensioning provided by an actuation system wherein the structure thereof is not complex, is easily adjustable, and provides a smooth and essentially vibrationless operation.

These, and additional objects, advantages, features and benefits of the present invention will become apparent from the following specification.

DETAILED DESCRIPTION OF THE PREFERRED EMBODIMENT

Figures 1, 2, 4:
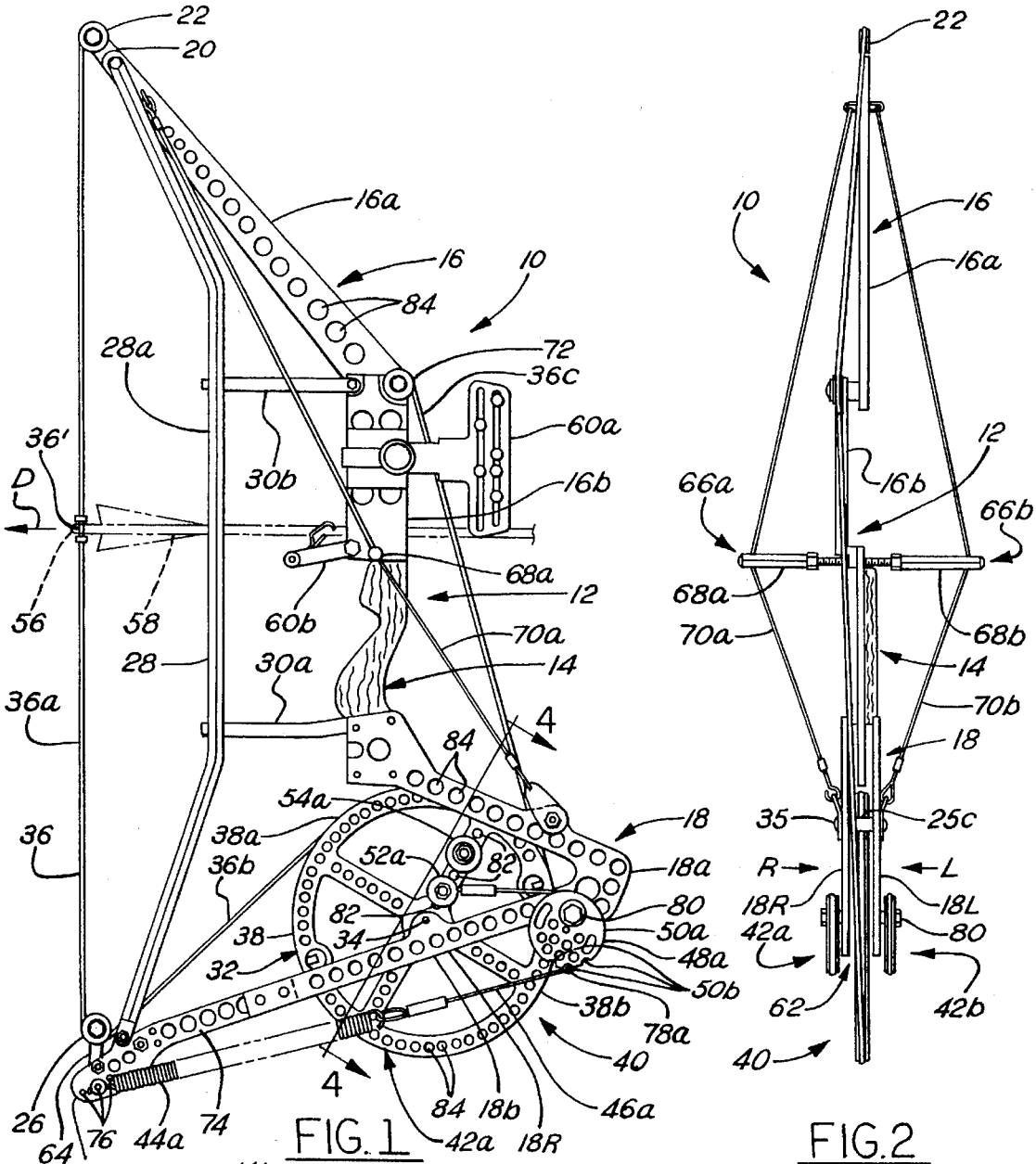
FIG. 1 is a right side view of the archery apparatus according to the present invention, wherein the bowstring thereof has not been drawn.
FIG. 2 is a front end view of the archery apparatus according to the present invention.
FIG. 4 is a partly sectional view of the archery apparatus according to the present invention, seen along line 4—4 in FIG. 1.
Figure 3:
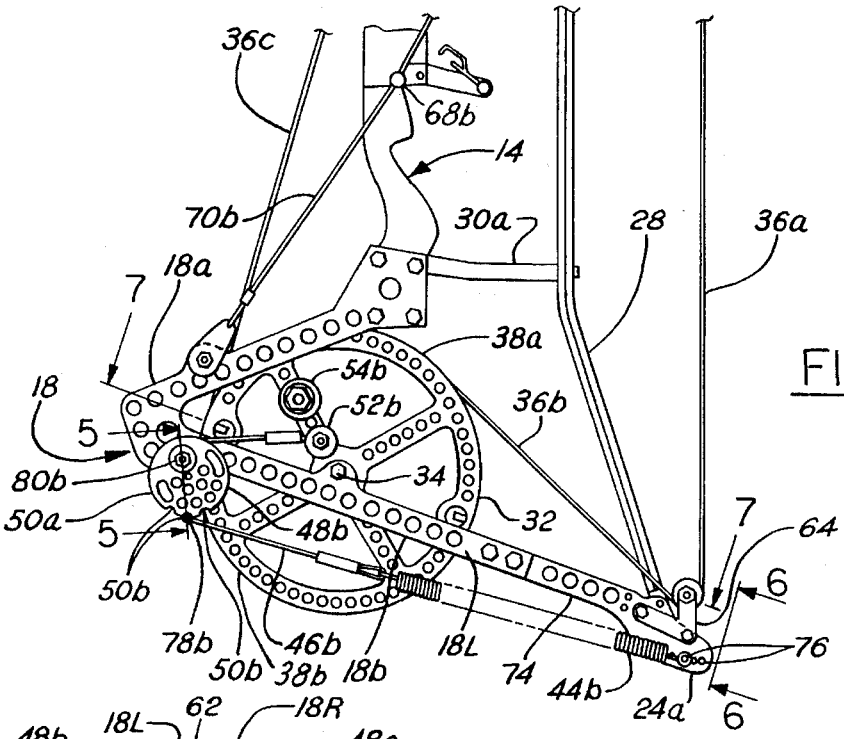
FIG. 3 is a detail left side view of the archery apparatus according to the present invention, showing in particular the actuation assembly thereof, wherein the bowstring has not been drawn.

Referring now to the Drawing, FIGS. 1 and 2 generally show the archery apparatus 10 according to the present invention. In this regard, a brief overview of the structure and function of the archery apparatus will first be detailed, followed by a detailing in depth.

The archery apparatus 10 includes a main frame 12 having a handle 14, an upper portion 16 connected to one end of the handle and a lower portion 18 connected with the other end of the handle. The main frame 12 is entirely rigid. The upper portion 16 of the main frame 12 includes an upper limb 16*a* which angles rearwardly with respect to the handle 14 and terminates at an upper tip 20 which carries an upper guide sheave 22. The lower portion 18 includes a V-shaped segment 18*a* forwardly disposed with respect to the handle 14, and a lower limb 18*b* which angles rearwardly with respect to the handle and terminates in a lower tip 24 which carries a lower guide sheave 26. A frame brace 28 connects to the main frame 12 adjacent each of the upper and lower tips 20, 24 and connects by linkages 30*a*, 30*b* with the main frame at the upper and lower portions 16, 18 substantially adjacent the handle 14.

The archery apparatus 10 further includes a main sheave 32 rotatably mounted to the lower limb 18*b* at an axis of rotation 34. A bowstring 36 extends between the upper and lower guide sheaves 22, 26, and the ends thereof wrap about and terminally connect at mutually opposing portions 38*a*, 38*b* of the periphery 38 of the main sheave 32.

The archery apparatus 10 still further includes an actuation system 40 for tensioning the bowstring 36 without flexing of the main frame 12. The actuation system 40 includes a pair of tensioning mechanisms 42*a*, 42*b*. Each tensioning mechanism 42*a*, 42*b* is composed of a coil spring 44*a*, 44*b*, wherein each first end thereof connects to the lower limb 18*b* adjacent the lower tip 24 and each second end thereof connects to a respective tensioning cable 46*a*, 46*b*. A cam sheave 48*a*, 48*b* is connected with the V-shaped segment 18*a* on each side thereof in spaced relation from both the axis of rotation 34 of the main sheave 32 and the second end of each spring 44*a*, 44*b*. Each tensioning cable 46*a*, 46*b* wraps in fixed relation about the periphery 50*a* of its respective cam sheave 48*a*, 48*b* and then rotatably connects at a respective connection member 52*a*, 52*b* with the main sheave 32 at a selected location with respect to the axis of rotation 34 thereof.

In operation, the archer places the nock 56 of an arrow 58 abuttably against the nocking point 36' of the bowstring 36 and then draws the bowstring in the direction of arrow D. The drawing of the bowstring 36 causes the main sheave 32 to rotate. Rotation of the main sheave 32 causes the tensioning cables 46*a*, 46*b* to extend the springs 44*a*, 44*b* while simultaneously causing the cam sheaves 48*a*, 48*b* to rotate off center. As the bowstring 36 approaches its maximum draw, the cam sheaves 48*a*, 48*b* and the main sheave 32 will have rotated so that the periphery 50*a* of each of the cam sheaves 48*a*, 48*b* approach alignment with the connection members 52*a*, 52*b* and further approach alignment with the axis of rotation 34 of the main sheave, thus reducing the force generated by the springs 44*a*, 44*b* on the bowstring to any residual level desired. A stop member 54*a*, 54*b* situated on each side of the main sheave 32 is located so as to abut the lower limb 18*b* at the desired point of maximum bowstring draw and desired amount of draw pull let-off. The archer may then easily hold the archery apparatus 10 in readiness for an extended time without tiring, with the nock 56 of an arrow 58 abutting the bowstring 36. When it is desired to release the arrow 58, the archer need only gently release the bowstring 36, whereupon the actuation system 40 will convert the draw energy into kinetic energy of the arrow in a smooth and essentially vibrationless manner which ensures high velocity and high accuracy of the arrow.

A more specific detailing of the structure and function of the archery apparatus 10 will now be detailed with reference being had additionally to FIGS. 3 through 11.

The main frame 12 may be integrally constructed as a single piece or may be constructed of mutually joined pieces using common fasteners to interconnect them. The main frame 12 is constructed of an inflexible material, such as for example wood, aluminum, titanium, plastic, composite, graphite, fiberglass, KEVLAR, other strong, durable and noncorrodable materials, and combinations thereof.

The handle 14 is preferably contoured to form fit a grasping hand and is located approximately midway between the upper and lower tips 20, 24. The handle 14 may or may not be in the form of a wood or plastic member coveringly connected with respect to the material of the main frame 12.

The upper portion 16 preferably includes a first segment 16*b* which is laterally recessed with respect to the handle 14 and the upper limb 16*a*, extending upwardly from the handle 14 in a generally parallel orientation with respect to the bowstring 36. The lateral recessing of the first segment 16*b* accommodates placement of the arrow 58 into axial alignment with the draw pull force of the bowstring 36 and further accommodates installation of conventional arrow aiming and sighting members 60*a*, 60*b*. The upper limb 16*a* angles rearwardly with respect to the handle 14 to locate the upper guide sheave 22 so as to provide a displacement of the bowstring 36 with respect to the handle an appropriate distance commensurate with the dimension of the arrows being used with the archery apparatus 10; for example, on the order of about 10 inches as measured when the bowstring is undrawn. The upper guide sheave 22 is preferably mounted to the upper tip 20 via bearings to minimize friction and vibration as the bowstring 36 moves with respect thereto.

The lower portion 18 includes a V-shaped segment 18*a* which connects with the handle 14 and projects forwardly with respect to the handle. The lower limb 18*b* is connected therewith and projects rearwardly with respect to the handle 14. Both the V-shaped segment 18*a* and a portion of the lower limb 18*b* preferably have matching left and right lower portion components 18L, 18R, respectively, on each side of the archery apparatus L, R. The left and right lower portion components 18L, 18R are mutually separated by spacers 25*a*, 25*b* and 25*c* to thereby form a clevis 62. Situated within the clevis 62 is the main sheave 32. The V-shaped segment 18*a* is preferably structured to more or less locate the axis of rotation 34 of the main sheave 32 more or less aligned with respect to the handle 14 and the first segment 16*b*. The main sheave 32 is mounted on a bearing supported axle at the axis of rotation 34 thereof, the axle connecting to the left and right lower portion components 18L, 18R, more or less at the point where the V-shaped segment 18*a* conjoins the lower limb 18*b*. An end segment 74 is connected, such as for example by fasteners 74*a*, to the left and right lower portion components 18L, 18R and extends rearwardly therefrom as a continuation of the lower limb 18*b*, terminating in the lower tip 24. The lower guide sheave 26 is mounted via a bracket 64 to the lower tip 24 to position the lower guide sheave so that the bowstring 36 is located with respect to the handle as described with respect to the upper guide sheave 22. The exact location of the drawing portion 36*a* of the bowstring 36 located between the upper and lower guide sheaves 22, 26 is adjusted by the bracket 64 pivoting on a first fastener 64*a*, with a second fastener 64c being affixed at a selected location with respect to a slot 64*b*. Again, the lower guide sheave 26 is preferably mounted to the lower tip 24 via bearings.

The frame brace 28 is included in order to provide bracing of the main frame 12. Depending upon the structural integrity of the main frame 12, the frame brace 28 may or may not be required. The frame brace 28, when present, preferably connects with the main frame 12 adjacent the lower tip 24 and adjacent the upper tip 20 to thereby keep the upper and lower tips relatively fixedly positioned when the bowstring 36 is fully drawn and great tension is acting on the upper and lower tips in a direction mutually toward one another. It is further preferred to further rigidly connect the frame brace 28 to the main frame 12 at the first segment 16*b* and the V-shaped segment 18*a* via linkages 30*a*, 30*b* to thereby prevent bending of the frame brace when the bowstring 36 is fully drawn. The frame brace 28 is provided with a laterally displaced segment 28*a* which accommodates placement of the arrow 58, in conformance with the lateral displacement of the first segment 16*b*.

In order to ensure that the main frame 12 is kept always straight between the upper and lower tips 20, 24, a guy and post system 66*a*, 66*b* is used, located on each of the left and right sides L, R of the main frame, as shown best in FIG. 2. Each post 68*a*, 68*b* is threadably connected with the main frame 12, and preferably located adjacent where the handle 14 meets the first segment 16*b*. The posts 68*a*, 68*b* are threadably connected with respect to the main frame 12 to thereby allow the length of the posts to be individually adjusted by threading or unthreading. Each guy 70*a*, 70*b* connects at one end thereof to the main frame 12 adjacent the upper tip 20, and at the other end to the main frame at a location on the V-shaped segment 18*a*, such as by a pin 35 which also carries spacers 25*c*. Each guy 70*a*, 70*b* connects with its respective post 68*a*, 68*b* adjacent the distal end thereof, either by passing through a hole therethrough or a slot therein (a hole being shown in FIG. 2). The length of the posts 68*a*, 68*b* causes the guys 70*a*, 70*b* to apply a torque on the main frame 12 which tends to bend it. Accordingly, if the main frame 12 becomes bent under stress from the forces generated by the actuation system 40, it can be bendably adjusted to be straight between the upper tip 20 and the lower tip 24 by careful individual adjustment of the length of the posts 68*a*, 68*b*. Of course, in the event the main frame 12 is structured so that it is inherently resistant to bending (an obviously advantageous feature, but one that may add excessive weight to the archery apparatus 10), then the guy and post system 66*a*, 66*b* may be obviated.

Figure 10:
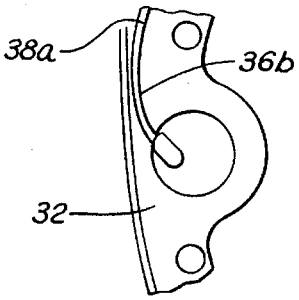
FIGS. 10 and 11 are detail side views of the periphery of the main sheave of the archery apparatus according to the present invention, particularly showing anchorage of the bowstring ends with respect thereto.
Figure 11:
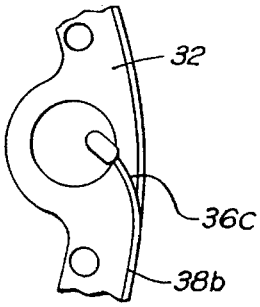

The bowstring 36 is preferred to be constructed of a very flexible and strong material. Bowstring materials and construction methodologies are well known in the art, and are incorporated in the present invention. For example, the bowstring 36 may be structured so that the drawing section 36*a* is selectively separable from the remainder thereof, in that this portion is subjected to arrow nock wear and may be equipped with various sighting and alignment markers. The bowstring 36 passes around each of the upper and lower guide sheaves 22, 26. A first section 36*b* of the bowstring 36 extends from the lower guide sheave 26 and then wraps around a first portion 38*a* of the periphery 38 of the main sheave 32, such as for example substantially fifty percent of the periphery, and is fixedly terminated thereto, as shown in FIG. 10. A second section 36*c* of the bowstring 36 extends from the upper guide sheave 22, passes over a secondary upper guide sheave 72 which is bearingly mounted to the first segment 16*b* for placing the bowstring out of the way of the arrow 58, and then wraps around a second portion 38*b* of the periphery 38 of the main sheave 32 (opposite the first portion 38*a*), such as for example substantially the other fifty percent of the periphery, and is fixedly terminated thereto, as shown in FIG. 11. It is to be understood that the amount of wrapping of the bowstring 36 on the periphery 38 of the main sheave 32 is dependent upon the amount of draw of the bowstring, during which the first and second sections 36*b*, 36*c* of the bowstring will unwind therefrom.

The actuation system 40 is composed of two tensioning mechanisms 42*a*, 42*b*,one located, respectively, on each of the left and right sides L, R of the archery apparatus 10.

Each spring 44*a*, 44*b* is preferred to be a coil spring having a high spring constant value. However, other resilient devices could be substituted therefor, such as gas charged springs. A first end of the springs 44*a*, 44*b* is connected with the end segment 74 adjacent the lower tip 24 via a pin 24*a*. A plurality of adjusting holes 76 affords simple adjustment of location of the pin 24*a* and thereby adjustment of the location of the first end of the springs with respect to the other components of the tensioning mechanisms 42*a*, 42*b* to thereby adjust spring tension.

Figure 5:
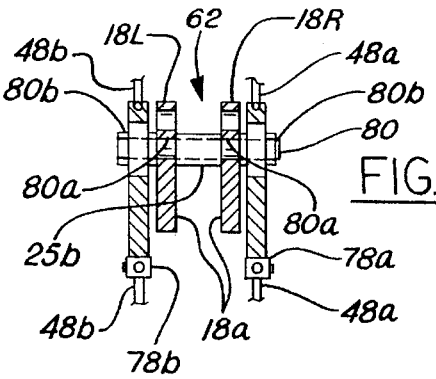
FIG. 5 is a partly sectional view of the archery apparatus according to the present invention, seen along line 5—5 in FIG. 3.
Figure 6:
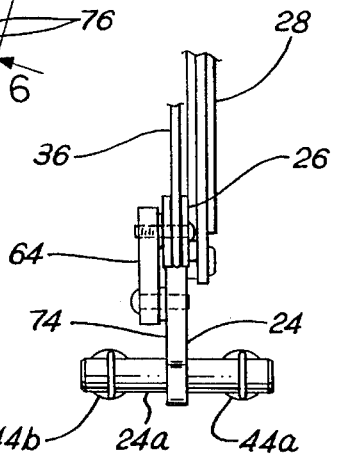
FIG. 6 is a detail view of the archery apparatus according to the present invention, seen along line 6—6 in FIG. 3.
Figure 7:
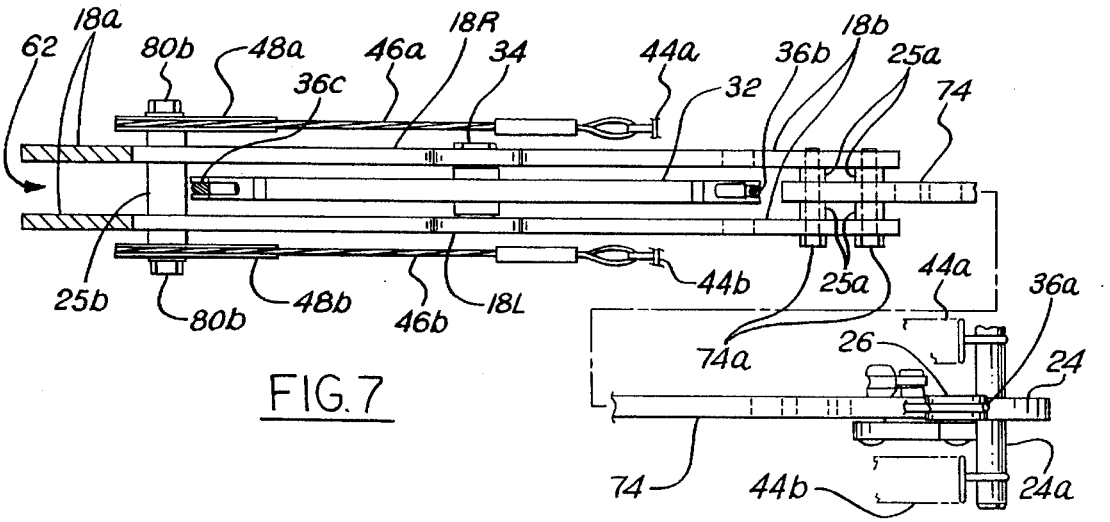
FIG. 7 is a partly sectional view of the archery apparatus according to the present invention, seen along line 7—7 in FIG. 3.
Figure 8:
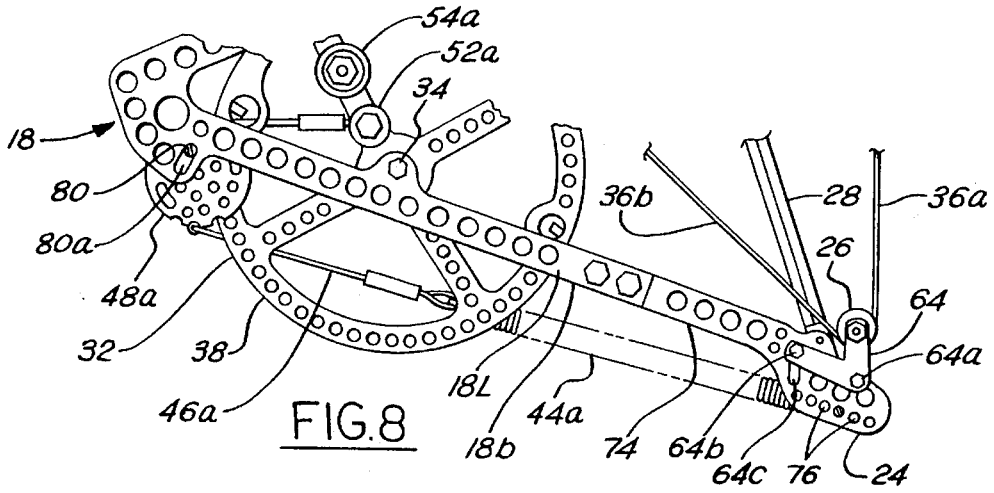
FIG. 8 is a partly sectional detail side view of the archery apparatus according to the present invention, showing in particular a portion of the actuation system thereof, wherein the bowstring has not been drawn.

Each cam sheave 48*a*, 48*b* is provided with a plurality of notches 50*b* on its periphery 50*a*. Each tensioning cable 46*a*, 46*b* is connected to a respective second end of the springs 44*a*, 44*b* and is further provided with a nib 78*a*, 78*b* fixedly connected thereto which seats in a selected respective notch 50*b*. Because each nib 78*a*, 78*b* seats with respect to a respective notch 50*b*, movement of the tensioning cables 46*a*, 46*b* necessarily entails rotation of the cam sheaves 48*a*, 48*b*. Each of the cam sheaves 48*a*, 48*b* is mounted eccentrically on a shaft 80 via bearings with respect to the V-shaped segment 18*a*. The location of the shaft 80 of the cam sheaves 48*a*, 48*b* is more or less opposite the location of the notches 50*b*, and wherein, as depicted in FIG. 1, when the bowstring is undrawn, the notches face substantially away from the lower limb 18*b*, oppositely with respect to the location of the axis of rotation 34 of the main sheave 32. The location of the shaft 80 with respect to the V-shaped segment 18*a* is selectively adjustable via an adjustment slot 80*a* in the V-shaped segment. In this regard, nuts 80*b* threadably secure to threaded ends of the shaft 80 so as to affix the shaft to a selected location within the adjustment slot 80*a*, as depicted in FIGS. 5 and 8.

The tensioning cables 46*a*, 46*b* are preferably constructed of interwoven metallic strands, but other materials may be used therefor. The tensioning cables 46*a*, 46*b* pass around respective cam sheaves 48*a*, 48*b*, such as for example substantially fifty percent thereof, and then terminate at a respective connection member 52*a*, 52*b* rotatably connected, preferably by bearings, with the main sheave 32. The location of attachment of the connection members 52*a*, 52*b* with respect to the main sheave 32 is adjustable via a plurality of holes 82 in radial alignment with respect to the main sheave 32.

Stop members 54*a*, 54*b*, preferably constructed of a resilient material such as hard rubber, are connected with the main sheave 32 via the holes 82 which serve to abut the lower limb 18*b* when the bowstring 36 is fully drawn. The size and/or placement of the stop members 54*a*, 54*b* adjusts the maximum bowstring draw possible.

Figure 9:
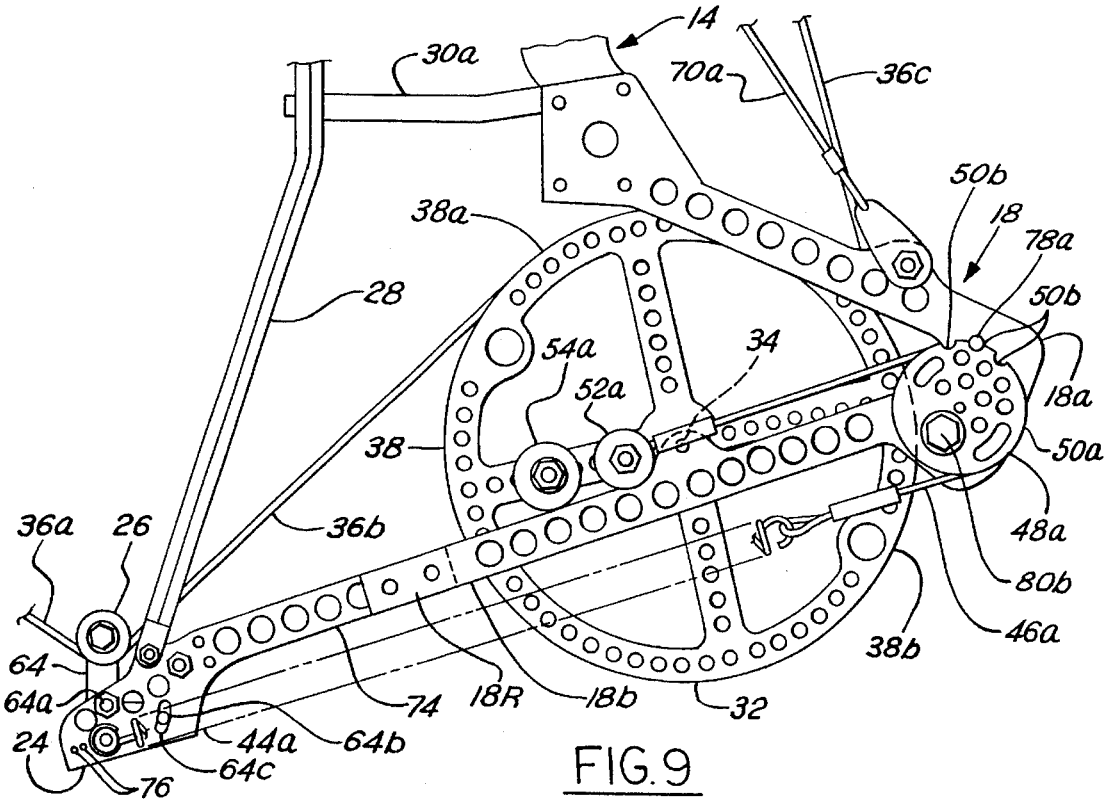
FIG. 9 is a detail right side view of the archery apparatus according to the present invention, showing in particular the actuation system thereof, wherein the bowstring has been fully drawn.

Operation of the archery apparatus 10 will now be detailed, with attention being directed comparatively between FIGS. 1 and 9.

The archer places the nock 56 of an arrow 58 abuttably against the nocking point 36' of the bowstring 36 and then draws the bowstring 36 in the direction of arrow D, as shown in FIG. 1. The drawing of the bowstring 36 causes the main sheave 32 to rotate as the first and second portions 36*b*, 36*c* thereof unwind therefrom. Rotation of the main sheave 32 causes the tensioning cables 46*a*, 46*b* to be pulled by movement of the connection members 52*a*, 52*b*. As the tensioning cables are pulled, the nibs 78*a*, 78*b* thereof which are seated in the selected notches 50*b* of the cam sheaves 48*a*, 48*b* cause the cam sheaves to rotate on their eccentrically located shaft 80. The movement of the tensioning cables 46*a*, 46*b* causes the springs 44*a*, 44*b* to be extended beyond whatever initially stretched condition they may have had when the bowstring was undrawn (preferably in this regard, there is considerable spring tension on the tensioning cables when the bowstring is undrawn). Because of the eccentric movement of the cam sheaves 48*a*, 48*b* on the shaft 80, a relatively small draw on the bowstring 36 causes a large extension of the springs 44*a*, 44*b* which consequently applies a torque onto the main sheave 32, which torque is dependent upon the lever arm formed by the connection members 52*a*, 52*b* in relation to the axis of rotation 34. It is to be noted that the eccentric movement of the cam sheaves 48*a*, 48*b* with respect to the tensioning cables 46*a*, 46*b* is selected by choice of notch 50*b* for seating of the nibs 78*a*, 78*b*. Accordingly, a large quantity of draw energy is stored even during the initial stages of drawing the bowstring 36.

As the bowstring approaches its maximum draw, the cam sheaves 48*a*, 48*b* and the main sheave 32 will have rotated so that the periphery 50*a*, 50*b* of each of the cam sheaves approaches alignment with the attachment location of the connection members 52*a*, 52*b* with respect to the main sheave and further approaches alignment with the axis of rotation 34 of the main sheave, thus reducing the aforesaid lever arm, and, consequently, the torque generated by the springs 44*a*, 44*b* on the main sheave 32 and the resulting tension on the bowstring 36 to any residual level desired. The stop members 54*a*, 54*b* situated on each side of the main sheave 32 are positioned at a predetermined location so as to abut the lower limb 18*b* at the desired point of maximum bowstring draw and desired amount of draw pull let-off per the amount of the aforesaid lever arm at abutment occurrence, as shown in FIG. 9. In this regard, by adjusting the location of the shaft 80 with respect to the adjustment slot 80*a* and/or the location of the connection members 52*a*, 52*b* with respect to the main sheave 32, and/or the placement or size of the stop members 54*a*, 54*b*, the degree of the aforesaid alignment can be set when the stop members abut the lower limb 18*b*. When the aforesaid alignment is exact, the aforesaid lever arm vanishes, the torque on the main sheave becomes zero and the draw pull becomes zero. Accordingly, at or near maximum draw the archer may easily hold the bowstring with the nock 56 of the arrow 58 abutting thereto in readiness for an extended time without tiring.

When it is desired to release the arrow 58, the archer need only gently release the bowstring 36, whereupon the actuation system 40 will convert the draw energy into kinetic energy of the arrow in a smooth and essentially vibrationless manner which ensures high velocity and high accuracy of the arrow. In this regard, the springs 44*a*, 44*b* pull the tensioning cables 46*a*, 46*b* to cause rotation of the cam sheaves 48*a*, 48*b*, the eccentric rotation of which causing rotation of the main sheave 32. As the main sheave 32 rotates, the first and second sections 36*b*, 36*c* of the bowstring wind around the periphery 38 of the main sheave as the amount of bowstring draw is forcibly reduced and the arrow is movably urged forward.

It is to be noted that while a plurality of weight reducing holes 84 are shown, only those utilized for adjustment purposes are directly related to the function of the archery apparatus 10.

It is to be further noted that because the actuation system 40 is connected with the lower portion 18 of the main frame 12, the center of gravity of the archery apparatus 10 is quite low, thereby enhancing the archer's ability to exactly control arrow aiming.

To those skilled in the art to which this invention appertains, the above described preferred embodiment may be subject to change or modification. For example, the upper and lower tips, which respectively carry the upper and lower guide sheaves, may be resiliently mounted to the main frame to thereby absorb bowstring shock. Further for example, the shape of the main frame may be varied from that shown. Still further for example, the shape and relative placement of the components of the archery apparatus may be modified to suit particular needs, such as the frame brace being modified to be centrally connected with respect to the upper and lower tips. Such change or modification can be carried out without departing from the scope of the invention, which is intended to be limited only by the scope of the appended claims.

What is claimed is:

1. An archery apparatus for propelling an arrow, comprising:

a main frame, said main frame being rigid, said main frame having an upper portion, an opposite lower portion and a handle located therebetween, said upper portion terminating in an upper tip, said lower portion terminating in a lower tip, wherein said lower portion of said main frame has a left side and a right side;

a bowstring strung substantially between said upper and lower tips;

guide sheave means connected with said main frame for guiding said bowstring; and actuation system means connected with said main frame and said bowstring for providing resilient tension on said bowstring selectively responsive to said bowstring being drawn with respect to said handle, said actuation system means comprising:

a main sheave rotatably connected to said lower portion of said main frame, said main sheave being rotatable about an axis, said main sheave having a periphery, said bowstring being affixed with respect to said periphery of said main sheave, said bowstring being selectively wrapped about said periphery of said main sheave; and tensioning member means connected with said lower portion of said main frame and said main sheave for selectively applying torque to said main sheave responsive to said bowstring being drawn, wherein said tensioning member means comprises:

left tension member means connected to said left side for providing a first torque component;

right tension member means connected to said right side for providing a second torque component, wherein said left and right torque components collectively provide said torque; and torque let-off means for selectively letting-off said torque as said bowstring is drawn at least a predetermined amount;

wherein as said bowstring is drawn, said bowstring at least in part unwinds with respect to said periphery of said main sheave, and wherein said torque urges said main sheave to rewind said bowstring with respect to said periphery thereof.

2. The archery apparatus of claim 1, wherein each of said left and right tension member means comprise:

resilient member means connected with said lower portion of said main frame for providing resilient pull;

cable means for transmitting to said main sheave said resilient pull of said resilient member means;

a cam sheave rotatably connected with said lower portion of said main frame, said cam sheave having a periphery, said cable means passing around a selected portion of said periphery of said cam sheave in affixed relation thereto; and connection member means connected with said main sheave for connecting said cable means to said main sheave at a location spaced a selected distance from said axis, wherein a portion of said cable means extends from a tangent of said periphery of said cam sheave to said connection member means;

wherein said torque applied to said main sheave is defined by said resilient pull transmitted by said cable means multiplied by a lever arm thereof intersecting said axis;

wherein said torque is selectively let-off as said location provided by said connection member means moves toward alignment with respect to said axis and said tangent of said periphery of said cam sheave of each of said left and right tension member means as said bowstring is drawn.

3. The archery apparatus of claim 2, wherein said resilient member means of each said left and right tension member means comprises a spring having a first end and an opposite second end, said first end of said spring being connected with said lower portion of said main frame, said second end of said spring being connected to said cable means.

4. The archery apparatus of claim 3, wherein said spring is a coil spring.

5. The archery apparatus of claim 2, further comprising cable adjustment means for providing positional adjustment of said cable means with respect to said periphery of said cam sheave of each said left and right tension member means.

6. The archery apparatus of claim 2, further comprising cam sheave adjustment means for providing positional adjustment of said cam sheave of each of said left and right tension member means with respect to said lower portion of said main frame.

7. The archery apparatus of claim 2, further comprising connection member adjustment means for providing positional adjustment of said connection member means of each said left and right tension member means with respect to said axis of said main sheave.

8. The archery apparatus of claim 2, further comprising stop member means connected with said main sheave for providing an abutment with respect to said main frame to thereby define a maximum draw of said bowstring and further define a maximum amount of said let-off of said torque.

9. The archery apparatus of claim 8, further comprising:

cable adjustment means for providing positional adjustment of said cable means with respect to said periphery of said cam sheave of each said left and right tension member means;

cam sheave adjustment means for providing positional adjustment of said cam sheave of each of said left and right tension member means with respect to said lower portion of said main frame; and connection member adjustment means for providing positional adjustment of said connection member means of each said left and right tension member means with respect to said axis of said main sheave.

10. The archery apparatus of claim 9, wherein said selected portion of said periphery of said cam sheave of each of said left and right tensioning means is substantially fifty percent thereof.

11. The archery apparatus of claim 9, further comprising frame brace means for retaining fixed placement of said upper tip with respect to said lower tip irrespective of drawing of said bowstring.

12. The archery apparatus of claim 11, further comprising post and guy means connected to each of said left and right sides for selectively adjusting straightness of said main frame between said upper and lower tips thereof.

13. An archery apparatus for propelling an arrow, comprising:

a main frame, said main frame being rigid, said main frame having an upper portion, an opposite lower portion and a handle located therebetween, said upper portion terminating in an upper tip, said lower portion terminating in a lower tip, said lower portion having a left side and a right side;

a bowstring strung substantially between said upper and lower tips;

upper guide sheave means for guiding said bowstring adjacent said upper tip;

lower guide sheave means for guiding said bowstring adjacent said lower tip; and actuation system means connected with said main frame and said bowstring for providing resilient tension on said bowstring selectively responsive to said bowstring being drawn with respect to said handle, said actuation system means comprising:

a main sheave rotatably connected to said lower portion of said main frame, said main sheave being rotatable about an axis, said main sheave having a periphery, said bowstring being affixed with respect to said periphery of said main sheave, said bowstring being selectively wrapped about said periphery of said main sheave; and left and right tensioning member means connected with said lower portion of said main frame and said main sheave for selectively applying torque to said main sheave responsive to said bowstring being drawn, said left and right tensioning member means comprising:

a left tensioning member means comprising:

left resilient member means connected with said left side of said lower portion of said main frame for supplying a left component of resilient pull;

left cable means for transmitting to said main sheave said left component of resilient pull of said left resilient member means;

a left cam sheave rotatably connected with said left side of said lower portion of said main frame, said left cam sheave having a periphery, said left cable means passing around a selected portion of said periphery of said left cam sheave in affixed relation thereto; and left connection member means connected with said main sheave for connecting said left cable member means to said main sheave at a location spaced a selected distance from said axis, wherein a portion of said left cable means extends from a tangent of said periphery of said left cam sheave to said left connection member means; and a right tensioning member means comprising:

right resilient member means connected with said right side of said lower portion of said main frame for supplying a right component of resilient pull;

right cable means for transmitting to said main sheave said right component of resilient pull of said right resilient member means;

a right cam sheave rotatably connected with said right side of said lower portion of said main frame, said right cam sheave having a periphery, said right cable means passing around a selected portion of said periphery of said right cam sheave in affixed relation thereto; and right connection member means connected with said main sheave for connecting said right cable member means to said main sheave at a location spaced said selected distance from said axis, wherein said right cable means extends from a tangent of said periphery of said right cam sheave to said right connection member means;

wherein said torque applied to said main sheave is defined by said left component of resilient pull transmitted by said left cable means multiplied by a left lever arm thereof intersecting said axis and said right component of resilient pull transmitted by said right cable means multiplied by a right lever arm thereof intersecting said axis;

wherein as said bowstring is drawn, said bowstring at least in part unwinds with respect to said periphery of said main sheave, wherein said torque urges said main sheave to rewind said bowstring with respect to said periphery thereof; and wherein said torque is selectively let-off as said locations respectively provided by said left and right connection member means move toward alignment with respect to said axis and respective said tangents of said peripheries of said left and right cam sheaves.

14. The archery apparatus of claim 13, wherein said lower portion of said main frame has a clevis formed therein, said main sheave being mounted in said clevis.

15. The archery apparatus of claim 14, wherein said left and right resilient member means comprise:

a left spring having a first end and an opposite second end, said first end of said left spring being connected with said left side of said lower portion of said main frame, said second end of said left spring being connected to said left cable means; and a right spring having a first end and an opposite second end, said first end of said right spring being connected with said right side of said lower portion of said main frame, said second end of said right spring being connected to said right cable means.

16. The archery apparatus of claim 15, further comprising stop member means connected with said main sheave for providing an abutment with respect to said main frame to thereby define a maximum draw of said bowstring and further define a maximum amount of said let-off of said torque.

17. The archery apparatus of claim 16, further comprising:

left and right cable adjustment means for providing positional adjustment of said left and right cable means, respectively, with regard to said peripheries of said left and right cam sheaves;

left and right cam sheave adjustment means for providing positional adjustment of said left and right cam sheaves, respectively, with regard to said lower portion of said main frame; and left and right connection member adjustment means for providing positional adjustment of said left and right connection member means with respect to said axis of said main sheave.

18. The archery apparatus of claim 13, further comprising frame brace means for retaining fixed placement of said upper tip with respect to said lower tip irrespective of drawing of said bowstring.

19. The archery apparatus of claim 13, further comprising post and guy means connect to each of said left and right sides for selectively adjusting straightness of said main frame between said upper and lower tips thereof.

20. An archery apparatus for propelling an arrow, comprising:

a main frame, said main frame being rigid, said main frame having an upper portion, an opposite lower portion and a handle located therebetween, said upper portion terminating in an upper tip, said lower portion terminating in a lower tip;

a bowstring strung substantially between said upper and lower tips;

guide sheave means connected with said main frame for guiding said bowstring; and actuation system means connected with said main frame and said bowstring for providing resilient tension on said bowstring selectively responsive to said bowstring being drawn with respect to said handle, said actuation system means comprising:

a main sheave rotatably connected to said lower portion of said main frame, said main sheave being rotatable about an axis, said main sheave having a periphery, said bowstring being affixed with respect to said periphery of said main sheave, said bowstring being selectively wrapped about said periphery of said main sheave; and tensioning member means connected with said lower portion of said main frame and said main sheave for selectively applying torque to said main sheave responsive to said bowstring being drawn, wherein said tensioning member means comprises:

resilient member means connected with said lower portion of said main frame for providing resilient pull;

cable means for transmitting said resilient pull to said main sheave;

cam means for camming said cable means, said cam means being rotatably connected with said lower portion of said main frame, said cam means having a periphery, said cable means passing around a selected portion of said periphery of said cam means in affixed relation thereto;

connection member means connected with said main sheave for connecting said cable means to said main sheave at a location spaced a selected distance from said axis, a portion of said cable means extending from a tangent of said periphery of said cam means to said connection member means; and torque let-off means for selectively letting-off said torque as said bowstring is drawn at least a predetermined amount, wherein said torque is selectively let-off as said location provided by said connection member means moves toward alignment with respect to said axis and said tangent of said periphery of said cam means;

wherein said torque is defined by said resilient pull transmitted by said cable means multiplied by a lever arm thereof intersecting said axis;

wherein as said bowstring is drawn, said bowstring at least in part unwinds with respect to said periphery of said main sheave, and wherein said torque urges said main sheave to rewind said bowstring with respect to said periphery thereof.

21. The archery apparatus of claim 20, further comprising:

cable adjustment means for providing positional adjustment of said cable means with respect to said periphery of said cam means;

cam adjustment means for providing adjustment of said camming of said cam means with respect to said cable means; and connection member adjustment means for providing positional adjustment of said connection member means with respect to said axis of said main sheave.

* * * * *